US008527083B2

(12) United States Patent
Tokura

(10) Patent No.: US 8,527,083 B2
(45) Date of Patent: Sep. 3, 2013

(54) SEWING MACHINE AND NON-TRANSITORY COMPUTER-READABLE MEDIUM STORING SEWING MACHINE CONTROL PROGRAM

(75) Inventor: Masashi Tokura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 281 days.

(21) Appl. No.: 13/042,008

(22) Filed: Mar. 7, 2011

(65) Prior Publication Data

US 2011/0226171 A1 Sep. 22, 2011

(30) Foreign Application Priority Data

Mar. 19, 2010 (JP) ..... 2010-064429

(51) Int. Cl.
*D05C 5/02* (2006.01)

(52) U.S. Cl.
USPC ..... 700/138; 112/102.5

(58) Field of Classification Search
USPC ..... 700/135, 136, 137, 138, 139; 112/102.5, 112/470.06, 470.04, 475.19
See application file for complete search history.

(56) References Cited

U.S. PATENT DOCUMENTS 4,998,489 A * 3/1991 Hisatake et al. ..... 112/103
5,042,410 A * 8/1991 Nakashima ..... 112/445
5,195,451 A * 3/1993 Nakashima ..... 112/102.5
5,323,722 A * 6/1994 Goto et al. ..... 112/102.5
5,537,946 A * 7/1996 Sadeh et al. ..... 112/475.03
5,553,559 A * 9/1996 Inoue et al. ..... 112/102.5
5,855,176 A * 1/1999 Takenoya et al. ..... 112/102.5
5,865,133 A * 2/1999 Herbach et al. ..... 112/475.19
5,911,182 A * 6/1999 Uyama et al. ..... 112/102.5
6,000,350 A * 12/1999 Koike et al. ..... 112/102.5
6,158,366 A * 12/2000 Codos ..... 112/117
6,167,822 B1 * 1/2001 Miyasako et al. ..... 112/102.5
6,407,745 B1 * 6/2002 Yamada et al. ..... 345/593

(Continued)

FOREIGN PATENT DOCUMENTS

EP 1 777 331 A1 4/2007
JP A-3-254782 11/1991

(Continued)

OTHER PUBLICATIONS

European Search Report issued in Application No. 11158244.1; Dated Aug. 2, 2011.

(Continued)

*Primary Examiner* — Danny Worrell
(74) *Attorney, Agent, or Firm* — Oliff & Berridge, PLC

(57) ABSTRACT

A sewing machine includes a moving portion that moves a sewing object having a pattern to a first position and to a second position, an image capture portion that creates an image by image capture of the sewing object, a first acquiring portion that acquires a first image created by image capture of a first area by the image capture portion, a second acquiring portion that acquires a second image created by image capture of a second area by the image capture portion, and a computing portion that computes, as position information, at least one of a thickness of the sewing object at a portion where the pattern is located and a position of the pattern on a surface of the sewing object, based on the first position, the second position, a position of the pattern in the first image, and a position of the pattern in the second image.

10 Claims, 15 Drawing Sheets

(56) References Cited

U.S. PATENT DOCUMENTS

| | | | | |
|---|---|---|---|---|
| 6,715,435 | B1 * | 4/2004 | Wieczorek et al. | 112/475.03 |
| 7,155,302 | B2 * | 12/2006 | Muto et al. | 700/138 |
| 7,702,415 | B2 * | 4/2010 | Roos | 700/138 |
| 7,848,842 | B2 * | 12/2010 | Suzuki et al. | 700/136 |
| 7,854,209 | B2 * | 12/2010 | Yamasaki | 112/444 |
| 2006/0096510 | A1 * | 5/2006 | Kuki et al. | 112/102.5 |
| 2007/0221107 | A1 | 9/2007 | Kato et al. | |
| 2009/0188413 | A1 * | 7/2009 | Hirata et al. | 112/103 |
| 2009/0188415 | A1 * | 7/2009 | Tokura | 112/470.01 |
| 2009/0217850 | A1 * | 9/2009 | Tokura | 112/102.5 |
| 2011/0146553 | A1 * | 6/2011 | Wilhelmsson et al. | 112/475.19 |

FOREIGN PATENT DOCUMENTS

| | | |
|---|---|---|
| JP | A-3-254783 | 11/1991 |
| JP | A-5-269285 | 10/1993 |
| JP | A-6-241748 | 9/1994 |
| JP | A-9-81779 | 3/1997 |
| JP | A-2000-55636 | 2/2000 |
| JP | A-2001-229388 | 8/2001 |
| JP | A-2001-330413 | 11/2001 |
| JP | A-2004-28728 | 1/2004 |
| JP | A-2004-144644 | 5/2004 |
| JP | A-2004-151883 | 5/2004 |
| JP | A-2005-115420 | 4/2005 |
| JP | A-2008-188148 | 8/2008 |
| JP | A-2009-172123 | 8/2009 |
| JP | A-2009-174981 | 8/2009 |
| JP | A-2009-201704 | 9/2009 |

OTHER PUBLICATIONS

U.S. Appl. No. 13/041,943, filed Mar. 7, 2011 by Tokura.
Nov. 28, 2012 Office Action issued in U.S. Appl. No. 13/041,943.

* cited by examiner

FIG. 9

| | | |
|---|---|---|
| 25 | 28 | 34 |
| 33 | 47 | 39 |
| 60 | 77 | 61 |

FIG. 10

| | | |
|---|---|---|
| 17 | 19 | 23 |
| 22 | 38 | 44 |
| 56 | 80 | 75 |

FIG. 15

| TYPE OF SEWN OBJECT | REFERENCE VALUE |
|---|---|
| WAFFLE FABRIC | A 1 |
| QUILTED FABRIC | A 2 |
| ⋮ | ⋮ |

SEWING MACHINE AND NON-TRANSITORY COMPUTER-READABLE MEDIUM STORING SEWING MACHINE CONTROL PROGRAM

CROSS-REFERENCE TO RELATED APPLICATION

This application claims priority to Japanese Patent Application No. 2010-064429, filed Mar. 19, 2010, the content of which is hereby incorporated herein by reference.

BACKGROUND

The present disclosure relates to a sewing machine that includes an image capture portion and to a non-transitory computer-readable medium that stores a sewing machine control program.

A sewing machine is known that includes an image capture device. This sort of sewing machine computes, based on a characteristic point in an image that has been created by the image capture device, three-dimensional coordinates that describe the position of the actual characteristic point. A height coordinate is necessary for the processing that computes the three-dimensional coordinates of the characteristic point. The sewing machine therefore one of computes the three-dimensional coordinates of the characteristic point by setting a specified value for the height coordinate and computes the three-dimensional coordinates of the characteristic point by detecting a thickness of an object to be sewn (hereinafter referred to as a "sewing object").

A sewing machine is known that is provided with a function that detects the thickness of a work cloth that is the object of the sewing. In this sort of sewing machine, the thickness of the work cloth is detected by an angle sensor that is provided on a member that presses the work cloth. A point mark at a position that corresponds to the work cloth thickness is illuminated by a marking light. A cloth stage detector detects the thickness of the work cloth based on the position of a beam of light that is projected onto the work cloth by a light-emitting portion and reflected by the work cloth.

SUMMARY

In the known sewing machines, in a case where the height coordinate of the characteristic point is not set appropriately, the three-dimensional coordinates of the characteristic point may not be computed appropriately based on the image that has been created by the image capture device. In a case where the thickness of the work cloth is detected by the known method, it is necessary for the sewing machine to be provided with a mechanism for detecting the thickness of the work cloth that is separate from the image capture device.

Various exemplary embodiments of the broad principles derived herein provide a sewing machine and a non-transitory computer-readable medium that stores a sewing machine control program. The sewing machine is provided with a function that acquires accurate position information from an image that has been captured by an image capture portion, without adding a new mechanism.

Exemplary embodiments provide the sewing machine that includes a moving portion that moves a sewing object to a first position and to a second position, the sewing object having a pattern, and an image capture portion that creates an image by image capture of the sewing object. The second position is different from the first position. The sewing machine also includes a first acquiring portion that acquires a first image created by image capture of a first area by the image capture portion, and a second acquiring portion that acquires a second image created by image capture of a second area by the image capture portion. The first area includes the pattern of the sewing object positioned at the first position. The second area includes the pattern of the sewing object positioned at the second position. The sewing machine further includes a computing portion that computes, as position information, at least one of a thickness of the sewing object at a portion where the pattern is located and a position of the pattern on a surface of the sewing object, based on the first position, the second position, a position of the pattern in the first image, and a position of the pattern in the second image.

Exemplary embodiments also provide a non-transitory computer-readable medium storing a control program executable on a sewing machine. The program includes instructions that cause a computer of the sewing machine to perform the steps of causing a moving portion of the sewing machine to move a sewing object having a pattern to a first position, creating a first image by image capture of a first area that includes the pattern of the sewing object positioned at the first position, and acquiring the first image that has been created. The program also includes instructions that cause the computer to perform the steps of causing the moving portion to move the sewing object to a second position that is different from the first position, creating a second image by image capture of a second area that includes the pattern of the sewing object positioned at the second position, and acquiring the second image that has been created. The program further includes instructions that cause the computer to perform the steps of computing, as position information, at least one of a thickness of the sewing object at a portion where the pattern is located and a position of the pattern on a surface of the sewing object, based on the first position, the second position, a position of the pattern in the first image, and a position of the pattern in the second image.

BRIEF DESCRIPTION OF THE DRAWINGS

Exemplary embodiments will be described below in detail with reference to the accompanying drawings in which:

FIG. 9 is an explanatory figure of pixel values in a first comparison area that is set within the first image;

FIG. 10 is an explanatory figure of pixel values in a second comparison area that is set within the second image;

FIG. 15 is a table that shows correspondences between reference values and types of sewing objects that are stored in an EEPROM 64.

DETAILED DESCRIPTION

Hereinafter, a sewing machine 1 according to first to third embodiments of the present disclosure will be explained in order with reference to the drawings. The drawings are used for explaining technical features that can be used in the present disclosure, and the device configuration, the flowcharts of various types of processing, and the like that are described are simply explanatory examples that does not limit the present disclosure to only the configuration, the flowcharts, and the like.

Figure 1:
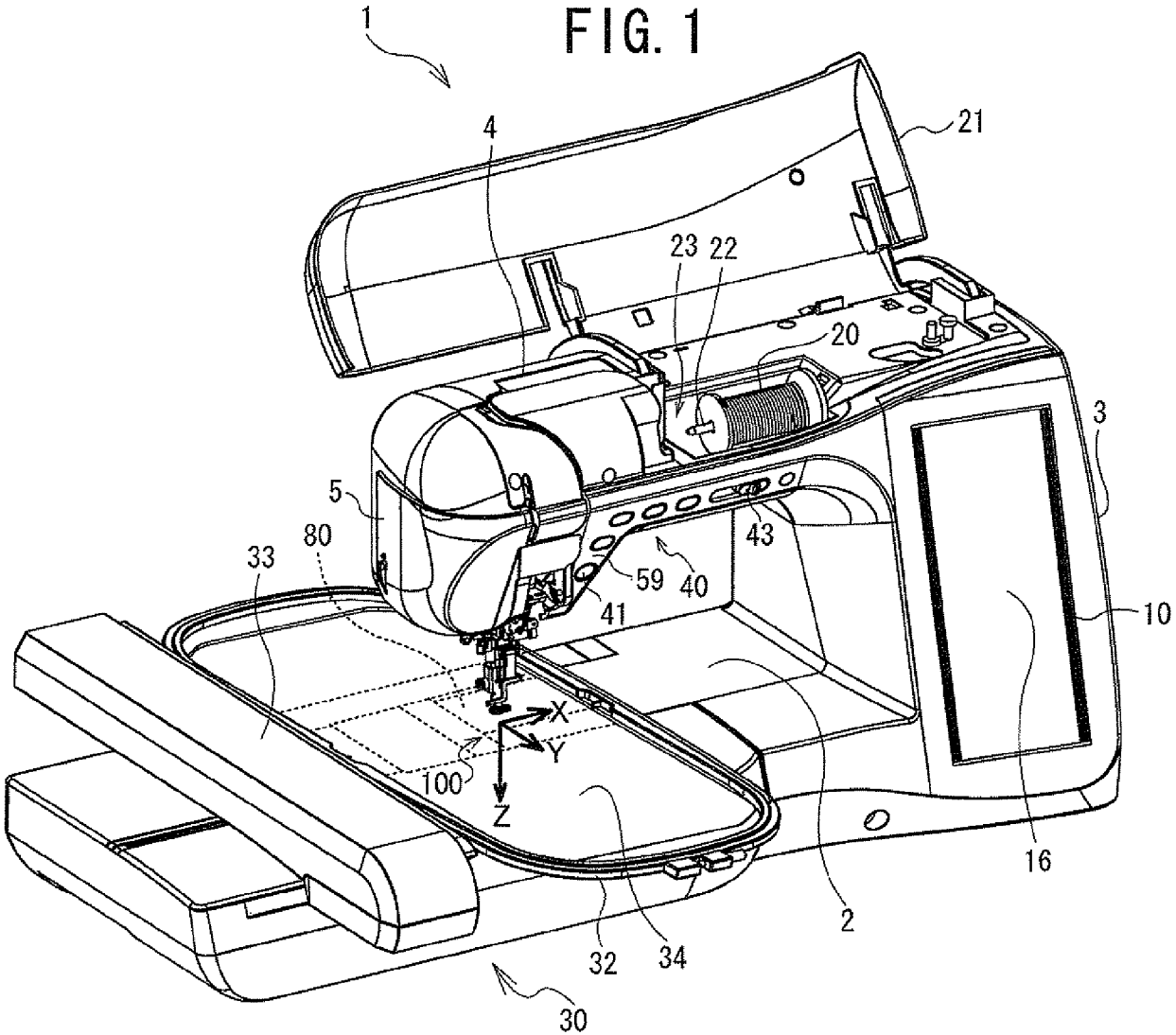
FIG. 1 is an oblique view of a sewing machine 1.

A physical configuration and an electrical configuration of the sewing machine 1 according to the first to third embodiments will be explained with reference to FIGS. 1 to 4. In FIG. 1, a direction of an arrow X, an opposite direction of the arrow X, a direction of an arrow Y, and an opposite direction of the arrow Y are respectively referred to as a right direction, a left direction, a front direction, and a rear direction. As shown in FIG. 1, the sewing machine 1 includes a bed 2, a pillar 3, and an arm 4. The long dimension of the bed 2 is the left-right direction. The pillar 3 extends upward from the right end of the bed 2. The arm 4 extends to the left from the upper end of the pillar 3. A head 5 is provided in the left end portion of the arm 4. A liquid crystal display (LCD) 10 is provided on a front surface of the pillar 3. A touch panel 16 is provided on a surface of the LCD 10. Input keys, which are used to input a sewing pattern and a sewing condition, and the like may be, for example, displayed on the LCD 10. A user may select a condition, such as a sewing pattern, a sewing condition, or the like, by touching a position of the touch panel 16 that corresponds to a position of an image that is displayed on the LCD 10 using the user's finger or a dedicated stylus pen. Hereinafter, an operation of touching the touch panel 16 is referred to as a "panel operation".

A feed dog front-and-rear moving mechanism (not shown in the drawings), a feed dog up-and-down moving mechanism (not shown in the drawings), a pulse motor 78 (refer to FIG. 4), and a shuttle (not shown in the drawings) are accommodated within the bed 2. The feed dog front-and-rear moving mechanism and the feed dog up-and-down moving mechanism drive the feed dog (not shown in the drawings). The pulse motor 78 adjusts a feed amount of a sewing object (not shown in the drawings) by the feed dog. The shuttle may accommodate a bobbin (not shown in the drawings) on which a lower thread (not shown in the drawings) is wound. An embroidery unit 30 may be attached to the left end of the bed 2. When the embroidery unit 30 is not used, a side table (not shown in the drawings) may be attached to the left end of the bed 2. When the embroidery unit 30 is attached to the left end of the bed 2, the embroidery unit 30 is electrically connected to the sewing machine 1. The embroidery unit 30 will be described in more detail below.

Figure 2:
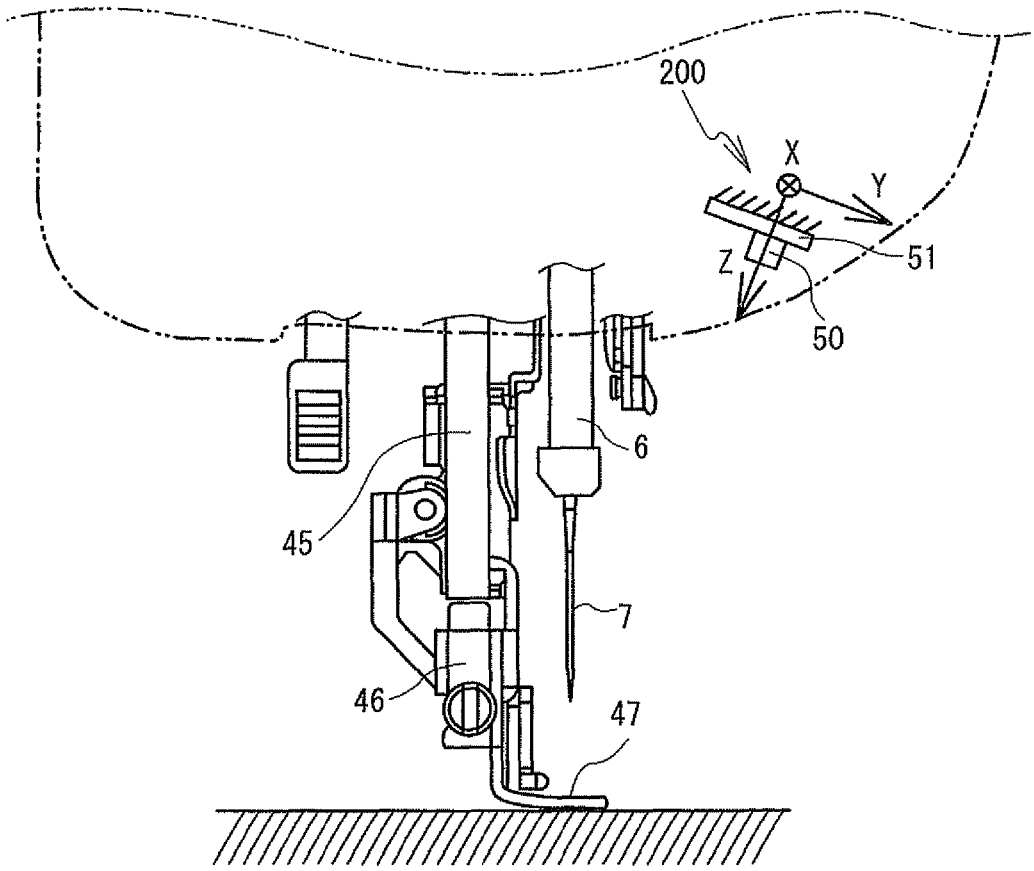
FIG. 2 is a diagram of an area around a needle 7 as seen from the left side of the sewing machine 1.

A sewing machine motor 79 (refer to FIG. 4), the drive shaft (not shown in the drawings), a needle bar 6 (refer to FIG. 2), a needle bar up-down moving mechanism (not shown in the drawings), and a needle bar swinging mechanism (not shown in the drawings) are accommodated within the pillar 3 and the arm 4. As shown in FIG. 2, a needle 7 may be attached to the lower end of the needle bar 6. The needle bar up-down moving mechanism moves the needle bar 6 up and down using the sewing machine motor 79 as a drive source. The needle bar swinging mechanism moves the needle bar 6 in the left-right direction using a pulse motor 77 (refer to FIG. 4) as a drive source. As shown in FIG. 2, a presser bar 45, which extends in the up-down direction, is provided at the rear of the needle bar 6. A presser holder 46 is fixed to the lower end of the presser bar 45. A presser foot 47, which presses a sewing object (not shown in the drawings) such as a work cloth, may be attached to the presser holder 46.

A top cover 21 is provided in the longitudinal direction of the arm 4. The top cover 21 is axially supported at the rear upper edge of the arm 4 such that the top cover 21 may be opened and closed around the left-right directional shaft. A thread spool housing 23 is provided close to the middle of the top of the arm 4 under the top cover 21. The thread spool housing 23 is a recessed portion for accommodating a thread spool 20. A spool pin 22, which projects toward the head 5, is provided on an inner face of the thread spool housing 23 on the pillar 3 side. The thread spool 20 may be attached to the spool pin 22 when the spool pin 22 is inserted through the insertion hole (not shown in the drawings) that is formed in the thread spool 20. Although not shown in the drawings, the thread of the thread spool 20 may be supplied as an upper thread to the needle 7 (refer to FIG. 2) that is attached to the needle bar 6 through a plurality of thread guide portions provided on the head 5. The sewing machine 1 includes, as the thread guide portions, a tensioner, a thread take-up spring, and a thread take-up lever, for example. The tensioner and the thread take-up spring adjust the thread tension of the upper thread. The thread take-up lever is driven reciprocally up and down and pulls the upper thread up.

A pulley (not shown in the drawings) is provided on a right side surface of the sewing machine 1. The pulley is used to manually rotate the drive shaft (not shown in the drawings). The pulley causes the needle bar 6 to be moved up and down. A front cover 59 is provided on a front surface of the head 5 and the arm 4. A group of switches 40 is provided on the front cover 59. The group of switches 40 includes a sewing start/stop switch 41 and a speed controller 43, for example. The sewing start/stop switch 41 is used to issue a command to start or stop sewing. If the sewing start/stop switch 41 is pressed when the sewing machine 1 is stopped, the operation of the sewing machine 1 is started. If the sewing start/stop switch 41 is pressed when the sewing machine 1 is operating, the operation of the sewing machine 1 is stopped. The speed controller 43 is used for controlling the revolution speed of the drive shaft. An image sensor 50 (refer to FIG. 2) is provided inside the front cover 59, in an upper right position as seen from the needle 7.

The image sensor 50 will be explained with reference to FIG. 2. The image sensor 50 is a known CMOS image sensor. The image sensor 50 is mounted in a position where the image sensor 50 can acquire an image of the bed 2 and a needle plate 80 that is provided on the bed 2. In the present embodiment, the image sensor 50 is attached to a support frame 51 that is attached to a frame (not shown in the drawings) of the sewing machine 1. The image sensor 50 captures an image of a specified image capture area that includes a needle drop point of the needle 7, and outputs image data that represent electrical signals into which incident light has been converted. The needle drop point is a position (point) where the needle 7 pierces the sewing object when the needle bar 6 is moved downward by the needle bar up-down moving mechanism (not shown in the drawings). Hereinafter, the outputting by the image sensor 50 of the image data that represent the electrical signals into which the incident light has been converted is referred to as the "creating of an image by the image sensor 50". In the present embodiment, position information for the sewing object is computed based on the image of the image capture area.

Figure 3:
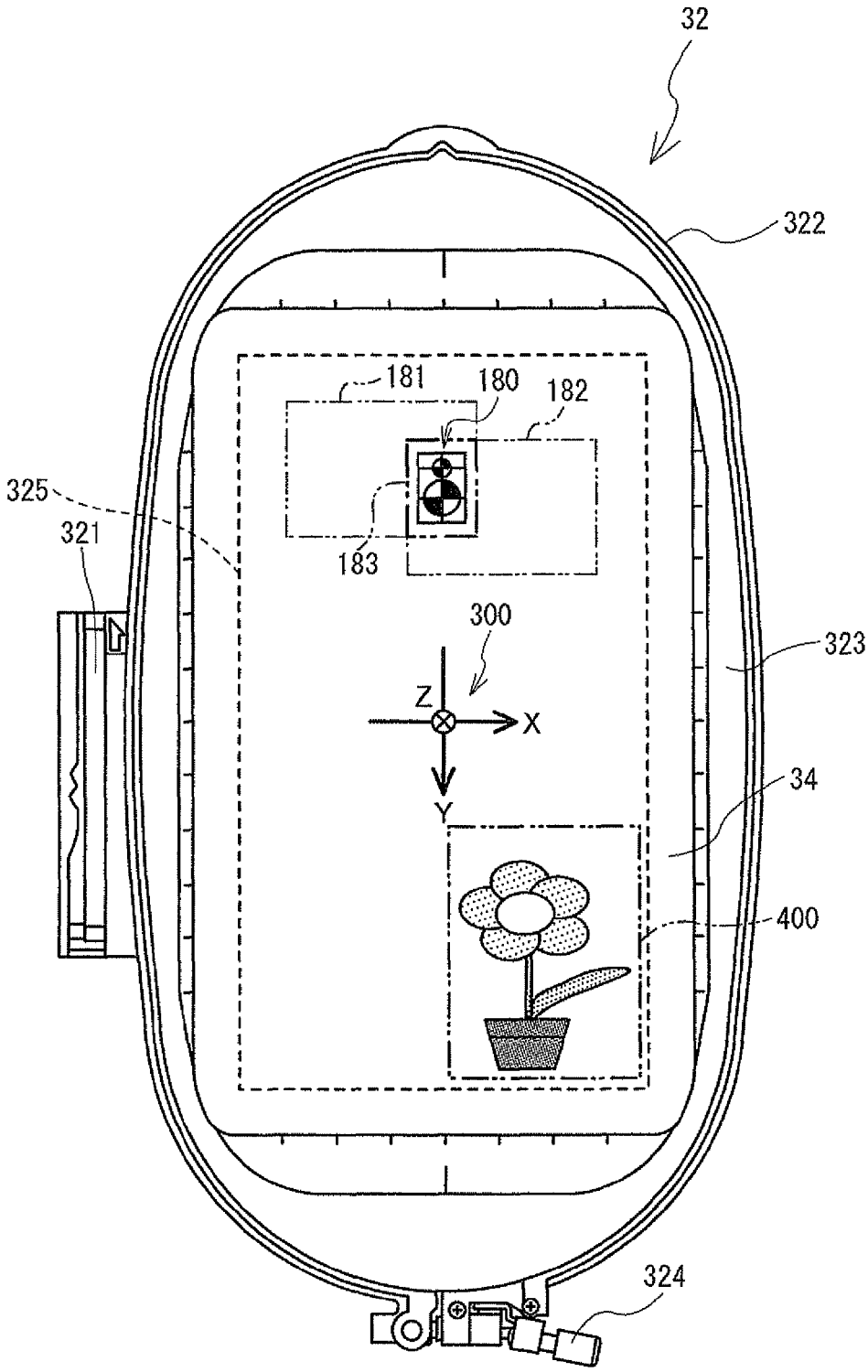
FIG. 3 is a plan view of an embroidery frame 32.

The embroidery unit 30 will be explained with reference to FIGS. 1 and 3. The embroidery unit 30 is provided with a function that causes the embroidery frame 32 to be moved in the left-right direction and in the front-rear direction. The embroidery unit 30 includes a carriage (not shown in the drawings), a carriage cover 33, a front-rear movement mechanism (not shown in the drawings), a left-right movement mechanism (not shown in the drawings), and the embroidery frame 32. The carriage may detachably support the embroidery frame 32. A groove portion (not shown in the drawings) is provided on the right side of the carriage. The groove portion extends in the longitudinal direction of the carriage. The embroidery frame 32 may be attached to the groove portion. The carriage cover 33 generally has a rectangular parallelepiped shape that is long in the front-rear direction. The carriage cover 33 accommodates the carriage. The front-rear movement mechanism (not shown in the drawings) is provided inside the carriage cover 33. The front-rear movement mechanism moves the carriage, to which the embroidery frame 32 may be attached, in the front-rear direction using a Y axis motor 82 (refer to FIG. 4) as a drive source. The left-right movement mechanism is provided inside a main body of the embroidery unit 30. The left-right movement mechanism moves the carriage, to which the embroidery frame 32 may be attached, the front-rear movement mechanism, and the carriage cover 33 in the left-right direction using an X axis motor 81 (refer to FIG. 4) as a drive source.

Based on an amount of movement that is expressed by coordinates in an embroidery coordinate system 300, drive commands for the Y axis motor 82 and the X axis motor 81 are output by a CPU 61 (refer to FIG. 4) that will be described below. The embroidery coordinate system 300 is a coordinate system for indicating the amount of movement of the embroidery frame 32 to the X axis motor 81 and the Y axis motor 82. In the embroidery coordinate system 300, the left-right direction that is the direction of movement of the left-right moving mechanism is the X axis direction, and the front-rear direction that is the direction of movement of the front-rear moving mechanism is the Y axis direction. In the embroidery coordinate system 300 in the present embodiment, in a case where the center of a sewing area of the embroidery frame 32 is directly below the needle 7, the center of the sewing area is defined as an origin position (X, Y, Z)=(0, 0, Z) in the XY plane. The embroidery unit 30 in the present embodiment does not move the embroidery frame 32 in the Z axis direction (the up-down direction of the sewing machine 1). The Z coordinate is therefore determined according to the thickness of a sewing object 34 such as the work cloth. The amount of movement of the embroidery frame 32 is set using the origin position in the XY plane as a reference position.

The embroidery frame 32 will be explained with reference to FIG. 3. The embroidery frame 32 includes a guide 321, an outer frame 322, an inner frame 323, and an adjusting screw 324. The guide 321 has a roughly rectangular shape in a plan view. A projecting portion (not shown in the drawings) that extends in the longitudinal direction of the guide 321 is provided roughly in the center of the bottom face of the guide 321. The embroidery frame 32 is mounted on the carriage (not shown in the drawings) of the embroidery unit 30 by attaching the projecting portion to the groove portion (not shown in the drawings) that is provided in the carriage. In a state in which the embroidery frame 32 is mounted on the carriage, the projecting portion is biased by an elastic biasing spring (not shown in the drawings) that is provided on the carriage, such that the projecting portion is pressed into the groove portion. The embroidery frame 32 and the carriage may thus be fitted together securely. The embroidery frame 32 may therefore move as a single unit with the carriage. The inner frame 323 may be fitted into the inner side of the outer frame 322. The outer circumferential shape of the inner frame 323 is formed into roughly the same shape as the inner circumferential shape of the outer frame 322. The sewing object 34, such as the work cloth, may be sandwiched between the outer frame 322 and the inner frame 323. The sewing object 34 is held by the embroidery frame 32 by tightening the adjusting screw 324, which is provided on the outer frame 322. A rectangular sewing area is established on the inside of the inner frame 323. An embroidery pattern may be formed in the sewing area 325. The embroidery frame 32 is not limited to the size that is shown in FIG. 1, and various sizes of embroidery frames (not shown in the drawings) have been prepared.

Figure 4:
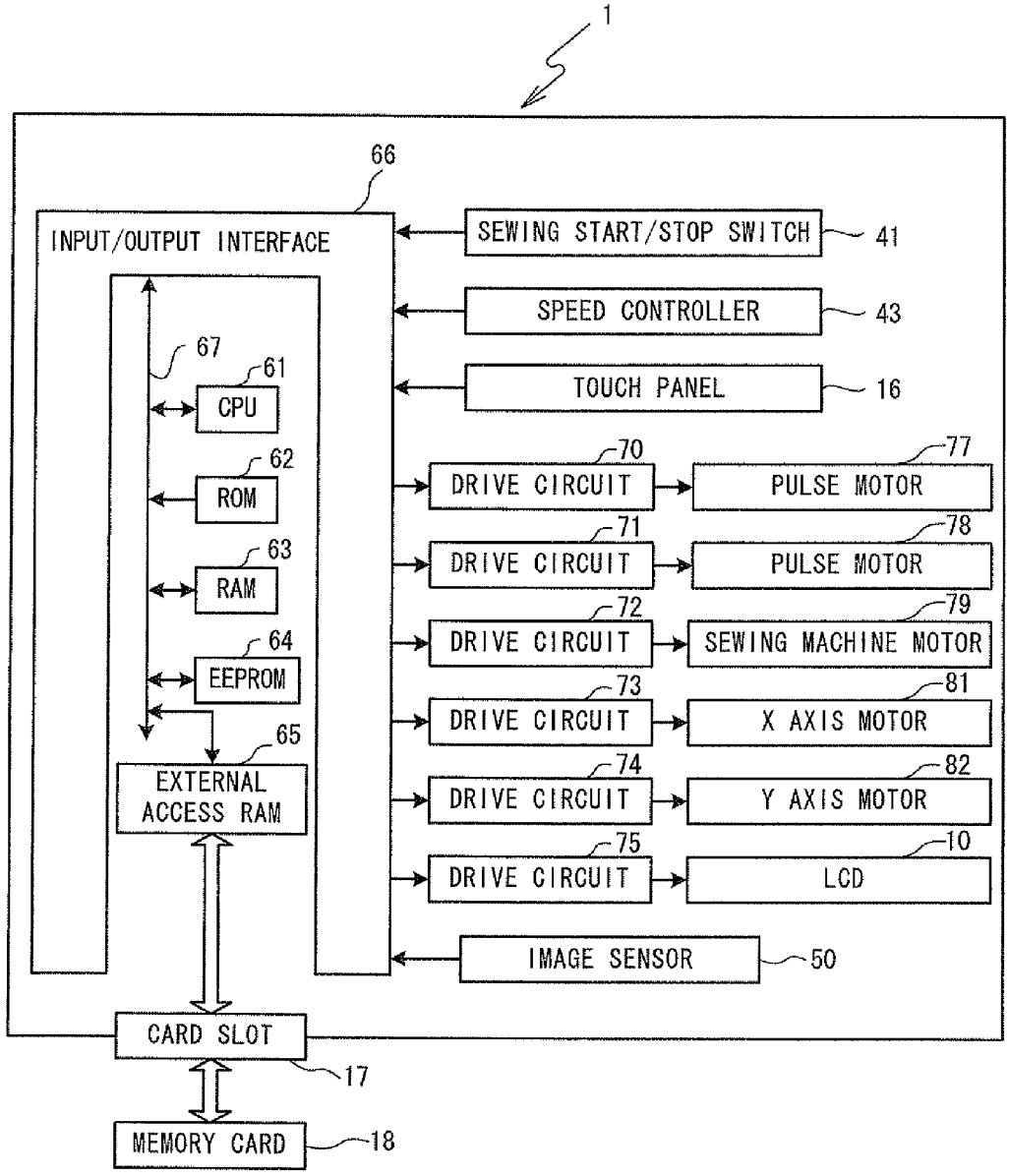
FIG. 4 is a block diagram that shows an electrical configuration of the sewing machine 1.

A main electrical configuration of the sewing machine 1 will be explained with reference to FIG. 4. As shown in FIG. 4, the sewing machine 1 includes the CPU 61, a ROM 62, a RAM 63, an EEPROM 64, an external access RAM 65, and an input/output interface 66, which are connected to one another via a bus 67.

The CPU 61 conducts main control over the sewing machine 1, and performs various types of computation and processing in accordance with programs stored in the ROM 62 and the like. The ROM 62 includes a plurality of storage areas including a program storage area. Programs that are executed by the CPU 61 are stored in the program storage area. The RAM 63 is a storage element that can be read from and written to as desired. The RAM 63 stores, for example, data that is required when the CPU 61 executes a program and computation results that is obtained when the CPU 61 performs computation. The EEPROM 64 is a storage element that can be read from and written to. The EEPROM 64 stores various parameters that are used when various types of programs stored in the program storage area are executed. Storage areas of the EEPROM 64 will be described in detail below. A card slot 17 is connected to the external access RAM 65. The card slot 17 can be connected to a memory card 18. The sewing machine 1 can read and write information from and to the memory card 18 by connecting the card slot 17 and the memory card 18.

The sewing start/stop switch 41, the speed controller 43, the touch panel 16, drive circuits 70 to 75, and the image sensor 50 are electrically connected to the input/output interface 66. The drive circuit 70 drives the pulse motor 77. The pulse motor 77 is a drive source of the needle bar swinging mechanism (not shown in the drawings). The drive circuit 71 drives the pulse motor 78 for adjusting a feed amount. The drive circuit 72 drives the sewing machine motor 79. The sewing machine motor 79 is a drive source of the drive shaft (not shown in the drawings). The drive circuit 73 drives the X axis motor 81. The drive circuit 74 drives the Y axis motor 82. The drive circuit 75 drives the LCD 10. Another element (not shown in the drawings) may be connected to the input/output interface 66 as appropriate.

The storage areas of the EEPROM 64 will be explained. The EEPROM 64 includes a settings storage area, an internal variables storage area, and an external variables storage area, which are not shown in the drawings. Setting values that are used when the sewing machine 1 performs various types of processing are stored in the settings storage area. The setting values that are stored may include, for example, correspondences between the types of embroidery frames and the sewing areas.

Internal variables for the image sensor 50 are stored in the internal variables storage area. The internal variables are parameters to correct a shift in focal length, a shift in principal point coordinates, and distortion of a captured image due to properties of the image sensor 50. An X-axial focal length, a Y-axial focal length, an X-axial principal point coordinate, a Y-axial principal point coordinate, a first coefficient of distortion, and a second coefficient of distortion are stored as internal variables in the internal variables storage area. The X-axial focal length represents an X-axis directional shift of the focal length of the image sensor 50. The Y-axial focal length represents a Y-axis directional shift of the focal length of the image sensor 50. The X-axial principal point coordinate represents an X-axis directional shift of the principal point of the image sensor 50. The Y-axial principal point coordinate represents a Y-axis directional shift of the principal point of the image sensor 50. The first coefficient of distortion and the second coefficient of distortion represent distortion due to the inclination of a lens of the image sensor 50. The internal variables may be used, for example, in processing that converts the image that the sewing machine 1 has captured into a normalized image and in processing in which the sewing machine 1 computes information on a position on the sewing object 34. The normalized image is an image that would presumably be captured by a normalized camera. The normalized camera is a camera for which the distance from the optical center to a screen surface is a unit distance.

External variables for the image sensor 50 are stored in the external variables storage area. The external variables are parameters that indicate the installed state (the position and the orientation) of the image sensor 50 with respect to a world coordinate system 100. Accordingly, the external variables indicate a shift of a camera coordinate system 200 with respect to the world coordinate system 100. The camera coordinate system is a three-dimensional coordinate system for the image sensor 50. The camera coordinate system 200 is schematically shown in FIG. 2. The world coordinate system 100 is a coordinate system that represents the whole of space. The world coordinate system 100 is not influenced by the center of gravity etc. of a subject. In the present embodiment, the world coordinate system 100 corresponds to the embroidery coordinate system 300.

An X-axial rotation vector, a Y-axial rotation vector, a Z-axial rotation vector, an X-axial translation vector, a Y-axial translation vector, and a Z-axial translation vector are stored as the external variables in the external variables storage area. The X-axial rotation vector represents a rotation of the camera coordinate system 200 around the X-axis with respect to the world coordinate system 100. The Y-axial rotation vector represents a rotation of the camera coordinate system 200 around the Y-axis with respect to the world coordinate system 100. The Z-axial rotation vector represents a rotation of the camera coordinate system 200 around the Z-axis with respect to the world coordinate system 100. The X-axial rotation vector, the Y-axial rotation vector, and the Z-axial rotation vector are used for determining a conversion matrix that is used for converting three-dimensional coordinates in the world coordinate system 100 into three-dimensional coordinates in the camera coordinate system 200, and vice versa. The X-axial translation vector represents an X-axial shift of the camera coordinate system 200 with respect to the world coordinate system 100. The Y-axial translation vector represents a Y-axial shift of the camera coordinate system 200 with respect to the world coordinate system 100. The Z-axial translation vector represents a Z-axial shift of the camera coordinate system 200 with respect to the world coordinate system 100. The X-axial translation vector, the Y-axial translation vector, and the Z-axial translation vector are used for determining a translation vector that is used for converting three-dimensional coordinates in the world coordinate system 100 into three-dimensional coordinates in the camera coordinate system 200, and vice versa. A 3-by-3 rotation matrix that is determined based on the X-axial rotation vector, the Y-axial rotation vector, and the Z-axial rotation vector and that is used for converting the three-dimensional coordinates of the world coordinate system 100 into the three-dimensional coordinates of the camera coordinate system 200 is defined as a rotation matrix R. A 3-by-1 vector that is determined based on the X-axial translation vector, the Y-axial translation vector, and the Z-axial translation vector and that is used for converting the three-dimensional coordinates of the world coordinate system 100 into the three-dimensional coordinates of the camera coordinate system 200 is defined as a translation vector t.

Figure 5:
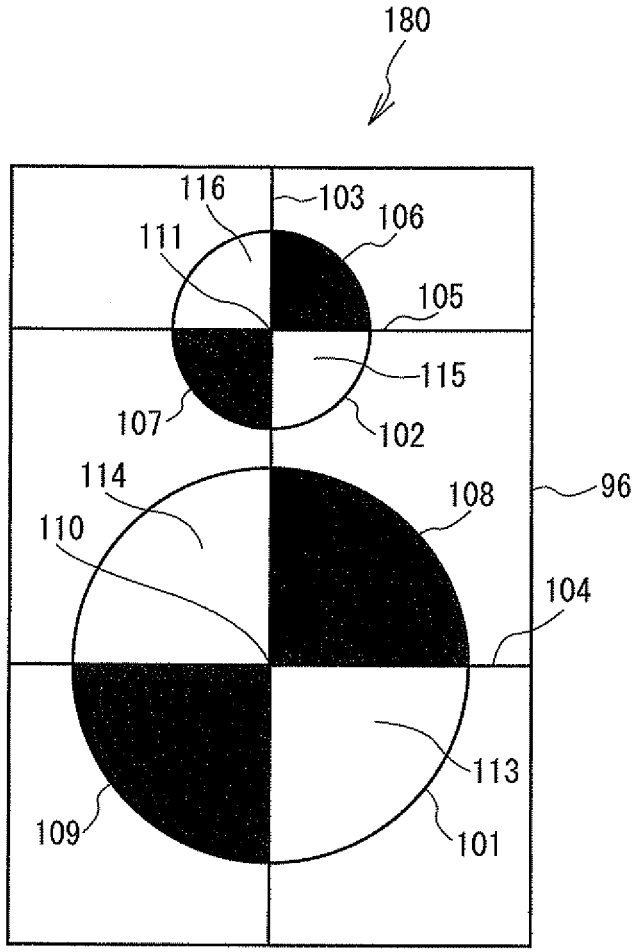
FIG. 5 is a plan view of a marker 180.

The marker 180 will be explained with reference to FIG. 5. The left-right direction and the up-down direction of the page of FIG. 5 are respectively defined as the left-right direction and the up-down direction of the marker 180. The marker 180 may be stuck to the top surface of the sewing object 34. The marker 180 may be used, for example, for specifying a sewing position for the embroidery pattern on the sewing object 34 and for acquiring the thickness of the sewing object 34. As shown in FIG. 5, the marker 180 is an object on which a pattern is drawn on a thin, plate-shaped base material sheet 96 that is transparent. The base material sheet 96 has a rectangular shape that is approximately 3 centimeters long by approximately 2 centimeters wide. Specifically, a first circle 101 and a second circle 102 are drawn on the base material sheet 96. The second circle 102 is disposed above the first circle 101 and has a smaller diameter than does the first circle 101. Line segments 103 to 105 are also drawn on the base material sheet 96. The line segment 103 extends from the top edge to the bottom edge of the marker 180 and passes through a center 110 of the first circle 101 and a center 111 of the second circle 102. The line segment 104 is orthogonal to the line segment 103, passes through the center 110 of the first circle 101, and extends from the right edge to the left edge of the marker 180. The line segment 105 is orthogonal to the line segment 103, passes through the center 111 of the second circle 102, and extends from the right edge to the left edge of the marker 180.

Of the four areas that are defined by the perimeter of the first circle 101, and the line segments 103 and the line segment 104, an upper right area 108 and a lower left area 109 are filled in with black, and a lower right area 113 and an upper left area 114 are filled in with white. Similarly, of the four areas that are defined by the second circle 102, the line segment 103 and the line segment 105, an upper right area 106 and a lower left area 107 are filled in with black, and a lower right area 115 and an upper left area 116 are filled in with white. The other portions of the surface on which the pattern of the marker 180 is drawn are transparent. The bottom surface of the marker 180 is coated with a transparent adhesive. When the marker 180 is not in use, a release paper is stuck onto the bottom surface of the marker 180. The user may peel the marker 180 off of the release paper and stick the marker 180 onto the surface of the sewing object 34.

Figure 6:
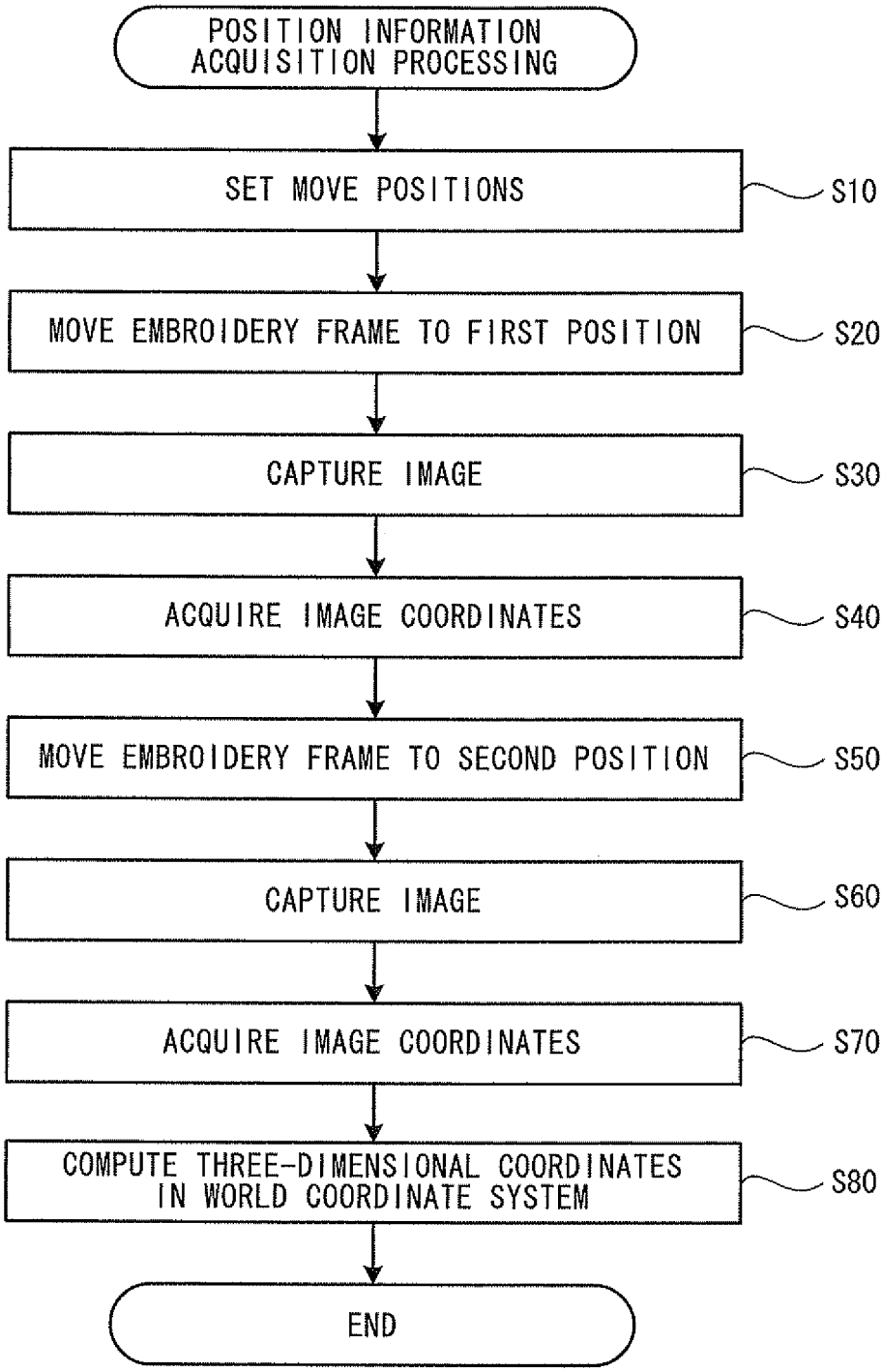
FIG. 6 is a flowchart of position information acquisition processing.

Position information acquisition processing that is performed by the sewing machine 1 according to the first embodiment will be explained with reference to the flowchart shown in FIG. 6. In the position information acquisition processing, three-dimensional coordinates in the world coordinate system 100 are computed for the marker 180 that is stuck onto the surface of the sewing object 34. In the present embodiment, the three-dimensional coordinates in the world coordinate system 100 may, for example, be computed for the center 110 of the first circle 101 of the marker 180 as a corresponding point. The position information acquisition processing may be performed in a case where, for example, at least one of the position of the marker 180 on the sewing object 34 and the thickness of the sewing object 34 is detected. A program for performing the position information acquisition processing in FIG. 6 is stored in the ROM 62 (refer to FIG. 4). The CPU 61 (refer to FIG. 4) performs the position information acquisition processing in accordance with the program that is stored in the ROM 62 in a case where a command is input by a panel operation.

As shown in FIG. 6, in the position information acquisition processing, first, move positions for the embroidery frame 32 are set, and the set move positions are stored in the RAM 63 (Step S10). In the processing at Step S10, a first position and a second position are set as two different move positions for the embroidery frame 32. The first position and the second position may be expressed as the move positions of the center point of the embroidery frame 32 in relation to the origin position, for example. The first position and the second position are set such that, in a case where the image sensor 50 captures images of the sewing object 34 in states in which the embroidery frame 32 has been moved to each of the first position and the second position, an image of the marker 180 will be included in each of the images that are thus created. Therefore, the image capture area when the embroidery frame 32 is positioned at the first position (hereinafter referred to as the first area) and the image capture area when the embroidery frame 32 is positioned at the second position (hereinafter referred to as the second area) partially overlap one another. The marker 180 is positioned in an area where the first area and the second area overlap. In the processing at Step S10, the first position and the second position may be set based on positions that are designated by the user, for example. The first position and the second position may be set after processing that detects the marker 180 has been performed, based on the detected position of the marker 180. In a case where the marker 180 is disposed on the surface of the sewing object 34 as shown in FIG. 3, a first area 181 and a second area 182 may be set, for example. The marker 180 is positioned in an area 183 where the first area 181 and the second area 182 overlap.

Next, drive commands are output to the drive circuits 73 and 74, and the embroidery frame 32 is moved to the first position that was set in the processing at Step S10 (Step S20). In a state where the embroidery frame 32 has been moved to the first position, an image of the sewing object 34 is captured by the image sensor 50. The image that is created by the image capture is stored in the RAM 63 as a first image (Step S30). Image coordinates $m=(u, v)^T$ for the center 110 are computed based on the created first image. The computed image coordinates m and world coordinates EmbPos (1) for the first position are stored in the RAM 63 (Step S40). The image coordinates are coordinates that are set according to a position within the image. $(u, v)^T$ represents a transposed matrix for (u, v). For example, Japanese Laid-Open Patent Publication No. 2009-172123 discloses the processing that specifies the image coordinates m for the marker 180, the relevant portions of which are incorporated by reference. In the same manner, the embroidery frame 32 is moved to the second position that was set in the processing at Step S10 (Step S50). An image of the sewing object 34 is captured, and the image that is created by the image capture is stored in the RAM 63 as a second image (Step S60). Image coordinates $m'=(u', v')^T$ for the center 110 are computed based on the created second image. The computed image coordinates m' and world coordinates EmbPos (2) for the second position are stored in the RAM 63 (Step S70). $(u', v')^T$ represents a transposed matrix for (u', v').

Three-dimensional coordinates for the center 110 in the world coordinate system 100 are computed using the image coordinates m and m' that were respectively computed in the processing at Steps S40 and S70. The computed coordinates are stored in the RAM 63 (Step S80). The three-dimensional coordinates for the center 110 in the world coordinate system 100 are computed by a method that applies a method that computes three-dimensional coordinates for a corresponding point of which images have been captured by cameras that are disposed at two different positions, by utilizing the parallax between the two camera positions. In the computation method that utilizes parallax, the three-dimensional coordinates for the corresponding point in the world coordinate system 100 are computed as hereinafter described. Under conditions in which the position of the embroidery frame 32 is not changed, in a case where the image coordinates $m=(u, v)^T$ and $m'=(u', v')^T$ are known for the corresponding point of which the images have been captured by the two cameras that are disposed at the different positions, then Equations (1) and (2) can be derived.

$$sm_{av}=PMw_{av} \quad \text{Equation (1)}$$

$$s'm_{av}'=P'Mw_{av} \quad \text{Equation (2)}$$

In Equation (1), P is a camera projection matrix that yields the image coordinates $m=(u, v)^T$. In Equation (2), P' is a camera projection matrix that yields the image coordinates $m'=(u', v')^T$. The projection matrices are matrices that include the internal variables and the external variables for the cameras. $m_{av}$, $m_{av}'$, and $Mw_{av}$ are augmented vectors of m, m', and Mw, respectively. Mw represents the three-dimensional coordinates of the corresponding point in the world coordinate system 100. The augmented vectors are derived by adding an element 1 to given vectors. For example, the augmented vector of $m=(u, v)^T$ is $m_{av}=(u, v, 1)^T$. s and s' are scalars.

Equation (3) is derived from Equations (1) and (2).

$$BMw=b \quad \text{Equation (3)}$$

In Equation (3), B is a matrix with four rows and three columns. An element Bij at row i and column j of the matrix B is expressed by Equation (4). b is expressed by Equation (5).

$$(B_{11}, B_{21}, B_{31}, B_{41}, B_{12}, B_{22}, B_{32}, B_{42}, B_{13}, B_{23}, B_{33}, B_{43})=(up_{31}-p_{11}, vp_{31}-p_{21}, u'p_{31}'-p_{11}', v'p_{31}'-p_{21}', up_{32}-p_{12}, vp_{32}-p_{22}, u'p_{32}'-p_{12}', v'p_{32}'-p_{22}', up_{33}-p_{13}, vp_{33}-p_{23}, u'p_{33}'-p_{13}', v'p_{33}-p_{23}') \quad \text{Equation (4)}$$

$$b=[p_{14}-up_{34}, p_{24}-vp_{34}, p_{14}'-u'p_{34}', p_{24}'-v'p_{34}']^T \quad \text{Equation (5)}$$

In Equations (4) and (5), $p_{ij}$ is the element at row i and column j of the matrix P. $p_{ij}'$ is the element at row i and column j of the matrix P'. $[p_{14}-up_{34}, p_{24}-vp_{34}, p_{14}'-u'p_{34}', p_{24}'-v'p_{34}']^T$ is a transposed matrix for $[p_{14}-up_{34}, p_{24}-vp_{34}, p_{14}'-u'p_{34}', p_{24}'-v'p_{34}']$.

Accordingly, Mw is expressed by Equation (6).

$$Mw=B^+b \quad \text{Equation (6)}$$

In Equation (6), $B^+$ expresses a pseudoinverse matrix for the matrix B.

In the method that utilizes the computation method described above that utilizes the parallax, the position of a single camera (the image sensor 50) is fixed, and the corresponding point (the center 110) is moved to the first position and the second position, where the images are captured. The three-dimensional coordinates for the corresponding point are computed by utilizing the distance between the first position and the second position. It is possible for any point within the area where the first area and the second area overlap to be set as the corresponding point, instead of the center 110. In the method that utilizes the computation method that utilizes the parallax, the three-dimensional coordinates for the corresponding point in the world coordinate system 100 are computed as described below.

First, the internal variables, and the rotation matrices and the translation vectors for the external variables for the image sensor 50 are computed for the case where the embroidery frame 32 is at the first position and the case where the embroidery frame 32 is at the second position. The internal variables for the image sensor 50 are parameters that are set based on characteristics of the image sensor 50. Accordingly, the internal variables do not change, even if the positioning of the embroidery frame 32 changes. Therefore, Equation (7) holds true.

(Internal variable $A_1$ at first position)=(Internal variable $A_2$ at second position)=(Internal variable A at origin position) Equation (7)

The embroidery frame 32 may be moved on the XY plane of the embroidery coordinate system 300 (the world coordinate system 100). Accordingly, the rotation matrix for the external variables for the image sensor 50 does not change, even if the positioning of the embroidery frame 32 changes. Therefore, Equation (8) holds true.

(Rotation matrix $R_1$ at first position)=(Rotation matrix $R_2$ at second position)=(Rotation matrix R at origin position) Equation (8)

On the other hand, the translation vectors describe a shift in the axial direction, so the translation vectors differ according to the positioning of the embroidery frame 32. Specifically, a translation vector $t_1$ in the case where the embroidery frame 32 is at the first position is expressed by Equation (9). A translation vector $t_2$ in the case where the embroidery frame 32 is at the second position is expressed by Equation (10).

(Translation vector $t_1$ at first position)=(Translation vector $t$ at origin position)+$R$(World coordinates EmbPos (1) at first position) Equation (9)

(Translation vector $t_2$ at second position)=(Translation vector $t$ at origin position)+$R$(World coordinates EmbPos (2) at second position) Equation (10)

It is therefore possible, by incorporating the amount of movement of the embroidery frame 32 into the setting of the translation vectors for the image sensor 50, to compute the three-dimensional coordinates for the corresponding point in the same manner as in a case in which the position of the embroidery frame 32 does not change and two of the image sensors 50 are disposed in different positions. In this case, P and P' are expressed by Equations (11) and (12), respectively.

$P=A[R, t_1]$ Equation (11)

$P'=A[R, t_2]$ Equation (12)

The internal variable A at the origin position is stored in the internal variables storage area of the EEPROM 64. The rotation matrix R at the origin position and the translation vector t at the origin position are stored in the external variables storage area of the EEPROM 64. The three-dimensional coordinates Mw in the world coordinate system 100 are computed by substituting into Equation (6) the values for m, m', P, and P' that have been derived as described above.

The position information acquisition processing is then terminated. The three-dimensional coordinates Mw (Xw, Yw, Zw) in the world coordinate system 100, which are the position information that is acquired by the position information acquisition processing, may be utilized, for example, in processing that acquires the position of the marker 180. Zw may be utilized, for example, in processing that acquires the thickness of the sewing object 34.

According to the sewing machine 1 according to the first embodiment, accurate position information can be acquired from the image that is created by the image capture by the image sensor 50, without the addition of a mechanism for detecting the thickness of the sewing object 34. The position information may be acquired by the simple operation of the user mounting the sewing object 34 in the embroidery frame 32. It is possible to detect the position information for a desired portion of the sewing object 34 by placing the marker 180 in the portion where the user desires to detect the position information. For example, even in a case where the sewing object 34 is a work cloth of a solid color, it is possible to detect the position information for the portion where the marker 180 is positioned by placing the marker 180 in the portion where the user desires to detect the position information. In a case where the shape of the marker 180 is stored in the sewing machine 1 in advance, the processing that specifies the position of the marker 180 in the first image and the second image can be performed more easily than in a case where the shape of the marker 180 is not identified. As described above, the embroidery frame 32 that holds the sewing object 34 may be held by the carriage that is included in the embroidery unit 30 and may be moved in the left-right direction and the front-rear direction. It is therefore possible to move the sewing object 34 from the first position to the second position more accurately than in a case where the sewing object 34 is moved by a feed dog. This makes it possible to acquire more accurate position information than in a case where the sewing object 34 is moved by the feed dog.

Figure 7:
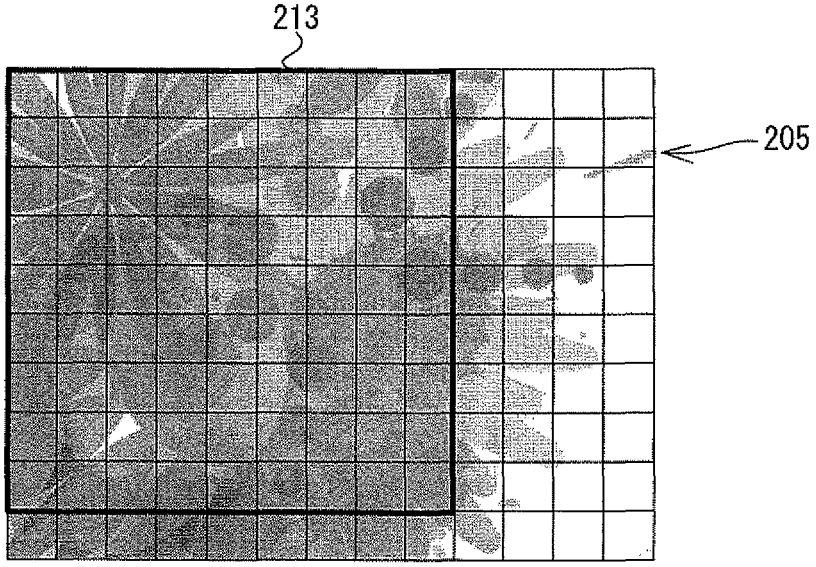
FIG. 7 is an explanatory figure of a first image 205 that is created in a case where an image of a pattern of a sewing object is captured in a state in which the embroidery frame 32 is in a first position.
Figure 8:
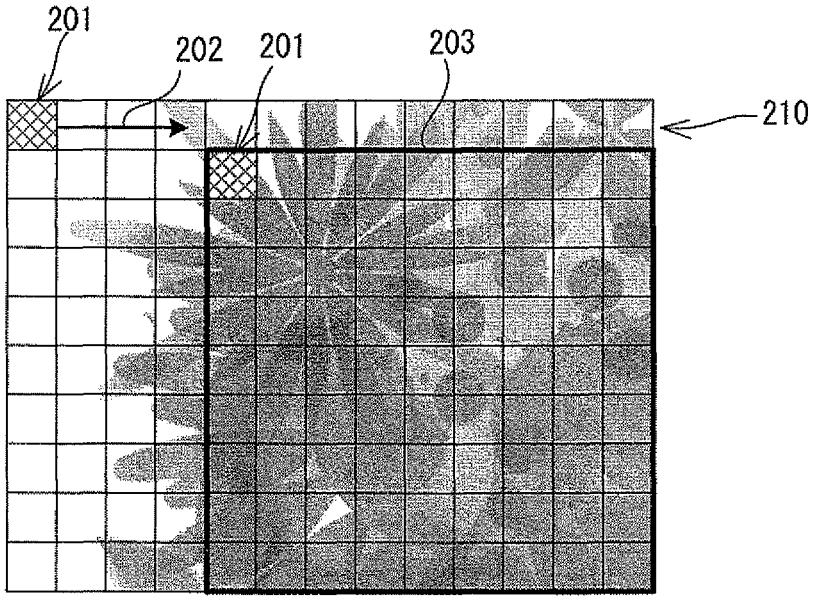
FIG. 8 is an explanatory figure of a second image 210 that is created in a case where an image of the pattern of the sewing object is captured in a state in which the embroidery frame 32 is in a second position, which is different from the first position.

In the position information acquisition processing in the embodiment that is described above, the position information may be acquired based on a pattern that the sewing object 34 has. In that case, a corresponding point in the pattern that the sewing object 34 has (an area in which the same pattern is visible) may be detected by a method that is described hereinafter, for example. A case is considered in which a first image 205 shown in FIG. 7 is created by image capture for the first area and a second image 210 shown in FIG. 8 is created by image capture for the second area. In FIGS. 7 and 8, the up-down direction and the left-right direction of the pages respectively correspond to the up-down direction and the left-right direction in the images.

In the processing that detects the corresponding point, the first image 205 and the second image 210 are each divided into small areas measuring several dots on each side. In order to simplify the explanation, in each of FIGS. 7 and 8, boundary lines that are drawn in a grid pattern divide the image into small areas, which each have a size of several tens of dots on each side. Next, a pixel value is computed for each of the small areas into which the image has been divided. Then a second comparison area is set in the second image 210. The second comparison area is used in processing that specifies an area in the first image 205 and the second image 210 where the same pattern is visible. The second comparison area is the largest rectangular area that can be defined with an upper left small area 201 at its upper left corner. The upper left small area 201 is a small area that is set in order from left to right and from top to bottom as indicated by an arrow 202 in FIG. 8. In FIG. 8, in a case where the upper left small area 201 is a small area in the second row and the fifth column, the second comparison area is the area that is enclosed by a rectangle 203.

Next, a first comparison area is set in the first image 205. The first comparison area is a rectangular area of the same size as the second comparison area, with the small area in the upper left corner of the first image 205 at its upper left corner. In a case where the second comparison area is the area that is enclosed by the rectangle 203 shown in FIG. 8, a rectangle 213 shown in FIG. 7 is set for the first comparison area. Next, an average value AVE of the absolute values of the differences in the pixel values between the first comparison area and the second comparison area is computed. For example, a case is considered in which the pixel values in the small areas in the first comparison area are the values that are shown in FIG. 9 and the pixel values in the small areas in the second comparison area are the values that are shown in FIG. 10. In order to simplify the explanation, in FIGS. 9 and 10, the first comparison area and the second comparison area are each defined as an area of three small areas by three small areas (i.e. nine small areas). In this case, a sum SAD of the absolute values of the differences between the pixel values in the same row and the same column is computed.

Next, the average value AVE is computed by dividing the sum SAD by the number of the absolute values. In the specific example, the sum SAD is computed to be 74, based on the equation $SAD=|25-17|+|33-22|+|60-56|+ \ldots +|61-75|$. The average value AVE is computed to be 8.22, based on the equation $AVE=74\div9$. The number of the obtained average values AVE corresponds to the number of the upper left small areas 201. A case in which, of the obtained average values AVE, an average value AVE is the lowest and is not greater than a specified value is specified as a case in which the first comparison area and the second comparison area correspond to one another. In the specific example, the second comparison area that is enclosed by the rectangle 203 corresponds to the first comparison area that is enclosed by the rectangle 213. The corresponding points in this case are the point at the upper left corner of the second comparison area and the point at the upper left corner of the first comparison area.

Figure 11:
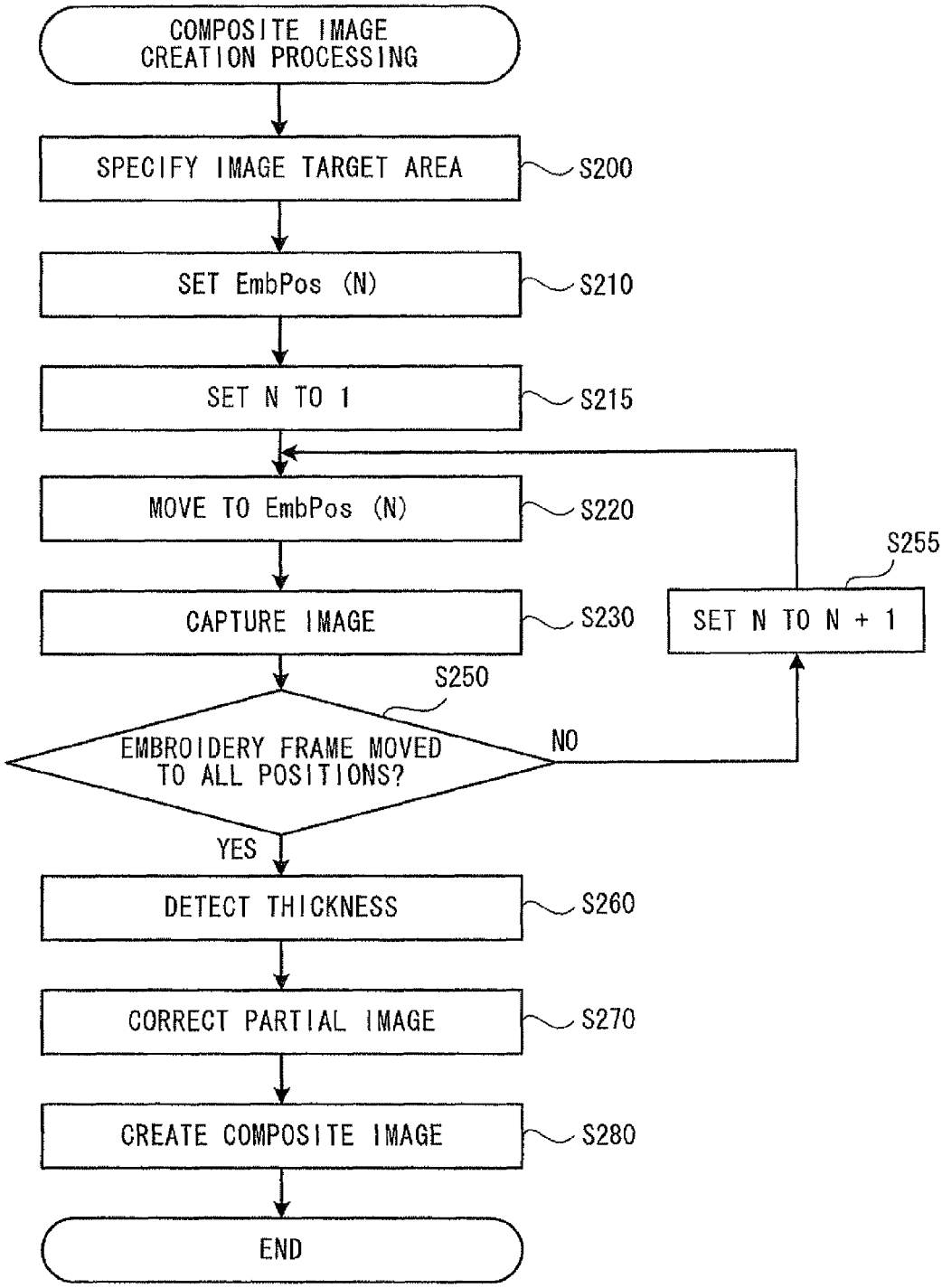
FIG. 11 is a flowchart of composite image creation processing.
Figure 12:
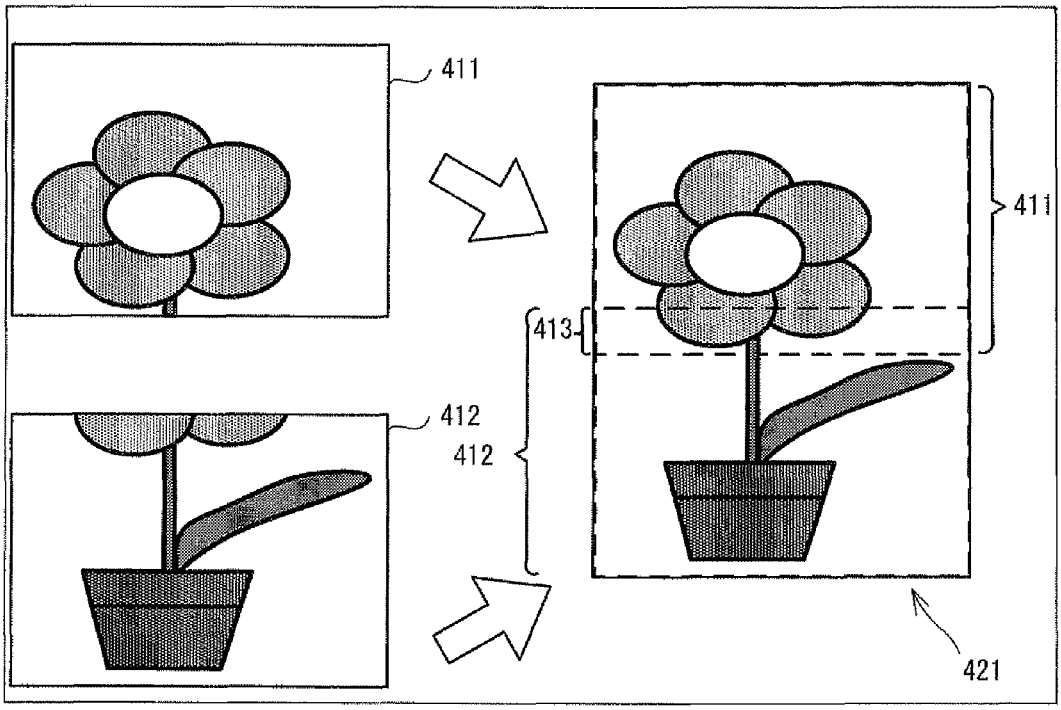
FIG. 12 is an explanatory figure of a composite image 421 that is created by combining a first image 411 and a second image 412.

Composite image creation processing that is performed by the sewing machine 1 according to the second embodiment will be explained with reference to FIGS. 11 and 12. In the composite image creation processing, a single composite image is created based on a plurality of images. In the composite image creation processing, the thickness of the sewing object 34 is utilized in processing that converts the image coordinates for the image that the image sensor 50 captures into the three-dimensional coordinates of the world coordinate system 100. The thickness of the sewing object 34 is computed based on the first image and the second image that are captured of one of the pattern of the sewing object 34 and the marker 180 that is disposed on the surface of the sewing object 34. An explanation of processing that is the same as a known method (for example, Japanese Laid-Open Patent Publication No. 2009-201704) will be simplified. A program for performing the composite image creation processing shown in FIG. 11 is stored in the ROM 62 (refer to FIG. 4). The CPU 61 (refer to FIG. 4) performs the composite image creation processing in accordance with the program that is stored in the ROM 62 in a case where a command is input by a panel operation.

As shown in FIG. 11, in the composite image creation processing, first, a capture target area is set, and the set capture target area is stored in the RAM 63 (Step S200). The capture target area is an area for which the composite image will be created. The capture target area is larger than the image capture area for which the image sensor 50 can capture in a single image. For example, one of an area for which is designated by a panel operation and a sewing area that corresponds to the type of the embroidery frame may be set as the capture target area. Correspondences between the types of embroidery frames and the sewing areas are stored in the EEPROM 64. In a case where the sewing area that corresponds to the type of the embroidery frame 32 is specified as the capture target area, the sewing area 325 is set as the capture target area, based on the correspondence relationship that is stored in the EEPROM 64. As a specific example, a case is considered in which an area that is enclosed by a rectangle 400 shown in FIG. 3 is specified as the capture target area by the user.

Next, EmbPos (N) is set, and the set EmbPos (N) is stored in the RAM 63 (Step S210). The EmbPos (N) denotes the N-th move position of the embroidery frame 32 for capturing the image of the capture target area that was set in the processing at Step S200. The EmbPos (N) is expressed by the coordinates of the embroidery coordinate system 300 (the world coordinate system 100). The variable N is a variable that is used for reading the move positions of the embroidery frame 32 in order. The EmbPos (N) and a maximum value M for the variable N vary according to the capture target area. In a case where the sewing area that corresponds to the type of the embroidery frame was set as the capture target area in the processing at Step S200, the EmbPos (N) is set in advance according to the type of the embroidery frame. The set EmbPos (N) is stored in the EEPROM 64. In a case where the capture target area is designated by a panel operation in the processing at Step S200, the EmbPos (N) is set based on conditions that include the capture target area and the image capture area that the image sensor 50 can capture in a single image. In the specific example, the first position and the second position are set as the two move positions in relation to the capture target area that is enclosed by the rectangle 400. The first position and the second position are set such that the first area and the second area partially overlap.

Next, the variable N is set to 1, and the set variable N is stored in the RAM 63 (Step S215). Next, the embroidery frame 32 is moved to the N-th position (Step S220). In the processing at Step S220, drive commands for moving the embroidery frame 32 to the position that is indicated by the EmbPos (N) that was set in the processing at Step S210 are output to the drive circuits 73, 74 (refer to FIG. 4). Next, an image of the sewing object 34 is captured by the image sensor 50, and the image that is created by the image capture is stored in the RAM 63 as an N-th partial image (Step S230). In the specific example, in the processing that is performed when N equals 1, the image of the sewing object 34 is captured in a state in which the embroidery frame 32 is at the first position, and a first image 411 shown in FIG. 12 is created by the image capture. In the processing that is performed when N equals 2, the image of the sewing object 34 is captured in a state in which the embroidery frame 32 is at the second position, and a second image 412 is created by the image capture.

Next, a determination is made as to whether the embroidery frame 32 has been moved to all of the move positions in the processing at Step S220 (Step S250). Specifically, a determination is made as to whether the variable N is equal to the maximum value M for the variable N. If the variable N is less than the maximum value M, there is a position remaining to which the embroidery frame 32 has not been moved (NO at Step S250). In that case, N is incremented by one, and the incremented N is stored in the RAM 63 (Step S255). The processing returns to Step S220, and the embroidery frame 32 is moved to the position that is indicated by the next EmbPos (N). If the variable N is equal to the maximum value M, the embroidery frame 32 has been moved to all of the move positions (YES at Step S250). In that case, the thickness of the sewing object 34 is detected based on the images that have been captured by the image sensor 50 (Step S260). Specifically, the thickness of the sewing object 34 is detected by the same sort of processing as the position information acquisition processing that is shown in FIG. 6, using the first image and the second image. The thickness of the sewing object 34 is used in correction processing for the partial images at Step S270. In the specific example, the thickness of the sewing object 34 is detected based on a pattern within an area 413 which is included in both the first image 411 and the second image 412.

Next, the correction processing for the partial images is performed (Step S270). Specifically, the image coordinates (u, v) of the pixels that are contained in the partial images are converted into the three-dimensional coordinates Mw (Xw, Yw, Zw) of the world coordinate system 100. The three-dimensional coordinates Mw (Xw, Yw, Zw) of the world coordinate system 100 are computed for each of the pixels that are contained in the partial images, using the internal variables and the external variables, and the computed coordinates Mw (Xw, Yw, Zw) are stored in the RAM 63. The correcting of the partial images is performed for all of the partial images that are created in the processing at Step S230. For example, Japanese Laid-Open Patent Publication No. 2009-201704 discloses the correction processing for the partial images, the relevant portions of which are incorporated by reference.

Image coordinates of a point p in the partial image are defined as (u, v), and three-dimensional coordinates of the point p in the camera coordinate system are defined as Mc (Xc, Yc, Zc). The X-axial focal length, the Y-axial focal length, the X-axial principal point coordinate, the Y-axial principal point coordinate, the first coefficient of distortion, and the second coefficient of distortion, which are internal variables, are respectively defined as fx, fy, cx, cy, $k_1$, and $k_2$.

First, coordinates (x", y") for a normalized image in the camera coordinate system are computed based on the internal variables and the image coordinates (u, v) of a point in the partial images. The coordinates (x", y") are computed based on the equations of $x''=(u-cx)/fx$ and $y''=(v-cy)/fy$. Next, coordinates (x', y') for the normalized image are computed by eliminating the distortion of the lens from the coordinates (x", y"). The coordinates (x', y') are computed based on the equations of $x'=x''-x''\times(1+k_1\times r^2+k_2\times r^4)$ and $y'=y''-y''\times(1+k_1\times r^2+k_2\times r^4)$. The equation $r^2=x''^2+y''^2$ holds true. The coordinates (x', y') for the normalized image in the camera coordinate system are converted into the three-dimensional coordinates Mc (Xc, Yc, Zc) in the camera coordinate system. The equations of $Xc=x'\times Zc$ and $Yc=y'\times Zc$ hold true. The equation $Mw=R^T(Mc-t)$ holds true between the three-dimensional coordinates Mc (Xc, Yc, Zc) in the camera coordinate system and the three-dimensional coordinates Mw (Xw, Yw, Zw) in the world coordinate system 100. $R^T$ is a transposed matrix for R. Zw is defined as the thickness of the sewing object 34 that was computed in the processing at Step S260. Zc, Xc, and Yc are computed by solving the equations $Xc=x'\times Zc$, $Yc=y'\times Zc$, and $Mw=R^T(Mc-t)$ as a set. Then the three-dimensional coordinates Mw (Xw, Yw, Zw) in the world coordinate system 100 are computed, and the computed three-dimensional coordinates Mw (Xw, Yw, Zw) are stored in the RAM 63.

Next, a composite image is created that combines the partial images that were corrected in the processing at Step S270. The created composite image is stored in the RAM 63 (Step S280). Specifically, the composite image is created as hereinafter described. First, the number (C_HEIGHT) of pixels in the vertical direction of the composite image and the number (C_WIDTH) of pixels in the horizontal direction of the composite image are computed based on the equations C_HEIGHT=T_HEIGHT/SCALE and C_WIDTH=T_WIDTH/SCALE. The SCALE is the length of one side of one pixel in a case where the pixels in the composite image are square. The T_HEIGHT and the T_WIDTH are respectively the length of the vertical direction and the length of the horizontal direction of the capture target area. In FIG. 3, the up-down direction and the left-right direction of the page respectively correspond to the vertical direction and the horizontal direction of the capture target area. Next, the image coordinates (x, y) in the composite image are computed that correspond to the three-dimensional coordinates $Mw_N$ ($Xw_N$, $Yw_N$, $Zw_N$) in the N-th partial image. The position EmbPos (N) of the embroidery frame 32 when the N-th partial image was captured is expressed by the three-dimensional coordinates ($a_N$, $b_N$, $c_N$) in the world coordinate system 100. In this case, the image coordinates (x, y) in the composite image that correspond to the three-dimensional coordinates $Mw_N$ ($Xw_N$, $Yw_N$, $Zw_N$) in the N-th partial image are computed by the equations of $x=Xw_N/SCALE+C_WIDTH/2+a_N/SCALE$ and $y=Yw_N/SCALE+C_HEIGHT/2+b_N/SCALE$. C_WIDTH/2 and C_HEIGHT/2 are set such that the values of the image coordinates (x, y) will not become negative. N partial images are combined based on the correspondence relationships between image coordinates ($u_N$, $v_N$) of a pixel in the N-th partial image and image coordinates (x, y) of a pixel in the composite image. In the specific example, a composite image 421 is created based on the first image 411 and the second image 412. The composite image creation processing is then terminated.

According to the sewing machine 1 according to the second embodiment, it is possible to create a composite image that describes the sewing object 34 more accurately than is the case where the composite image is created without taking into account the thickness of the sewing object 34. In the specific example, the composite image 421 is created based on two images, namely the first image 411 and the second image 412. However, the composite image may be created based on more than two images.

Held state check processing that is performed by the sewing machine 1 in the third embodiment will be explained with reference to FIGS. 13 to 15. In the held state check processing, the state of the sewing object 34 that is held by the embroidery frame 32 (hereinafter referred to as the held state) is checked. In the held state check processing, a determination is made as to whether, as a particular held state, there is any slack in the sewing area of the sewing object 34. Specifically, in a case where the user causes the sewing object 34 to be held in the embroidery frame 32, a determination is made as to whether the sewing object 34 is being held by the embroidery frame 32 without any slack. If there is slack in the sewing object 34, a sewing defect may occur. For example, a portion of the sewing object 34 may be pulled by the tension of the thread in the stitches of the embroidery pattern, causing the embroidery pattern to be distorted. Therefore, in the held state check processing, any slack in the sewing object 34 is detected before the sewing is performed, and the user may be notified of the detection result.

Hereinafter, the specific processing will be explained. First, a plurality of small areas are set within the sewing area, and the thickness of the sewing object 34 is detected in each of the small areas. The thickness of the sewing object 34 is computed based on the first image and the second image that are captured of one of the pattern of the sewing object 34 and the marker 180 that is disposed on the surface of the sewing object 34. A determination is made as to whether slack is present or absent, based on the deviation in the thickness of the sewing object 34 between the individual small areas. As a specific example, a case is considered in which the held state is detected for a sewing object 501 within a sewing area 325, as shown in FIG. 14. The sewing object 501 is defined as a work cloth on which are printed patterns of potted flowers and butterflies.

Figure 13:
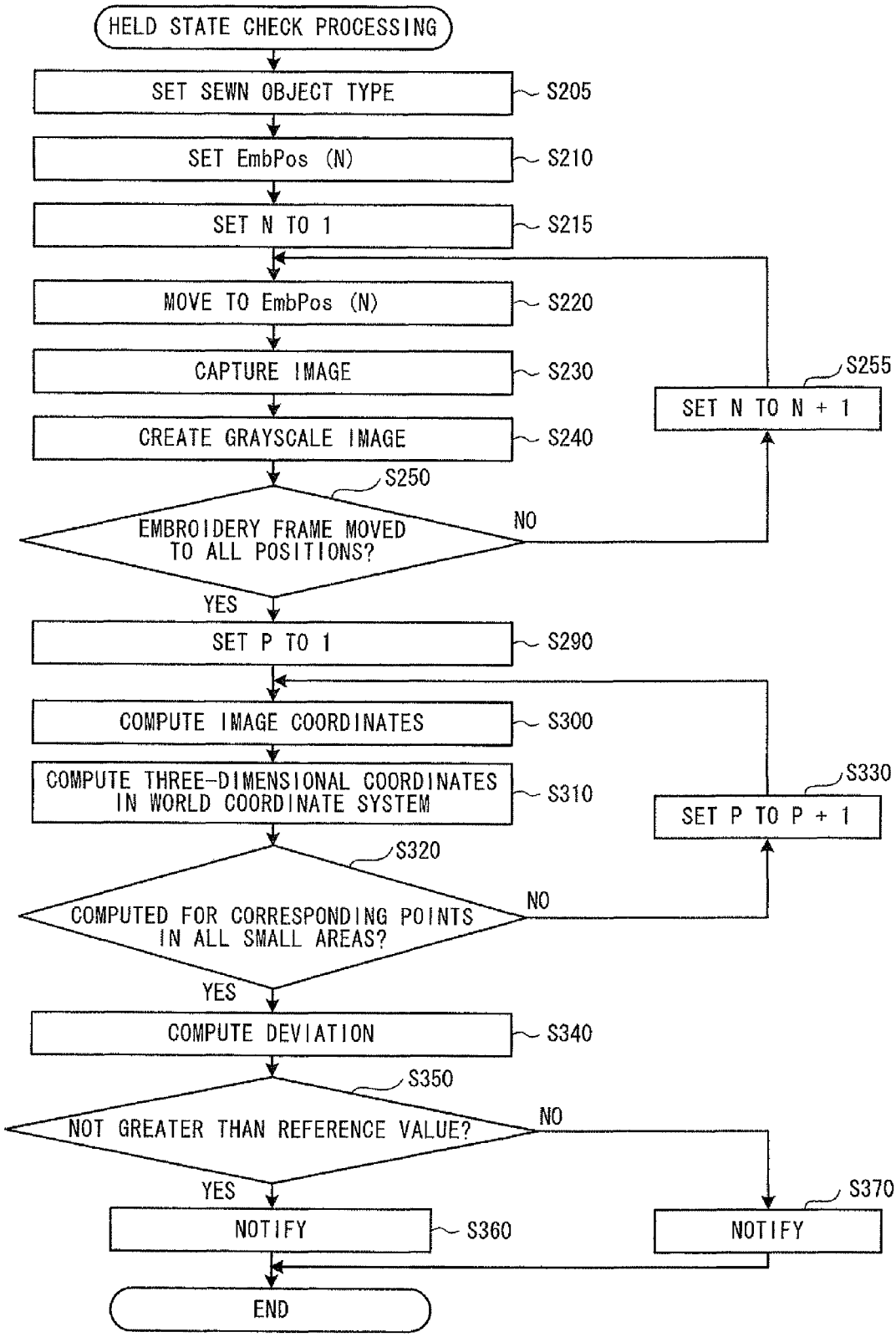
FIG. 13 is a flowchart of held state check processing.
Figure 14:
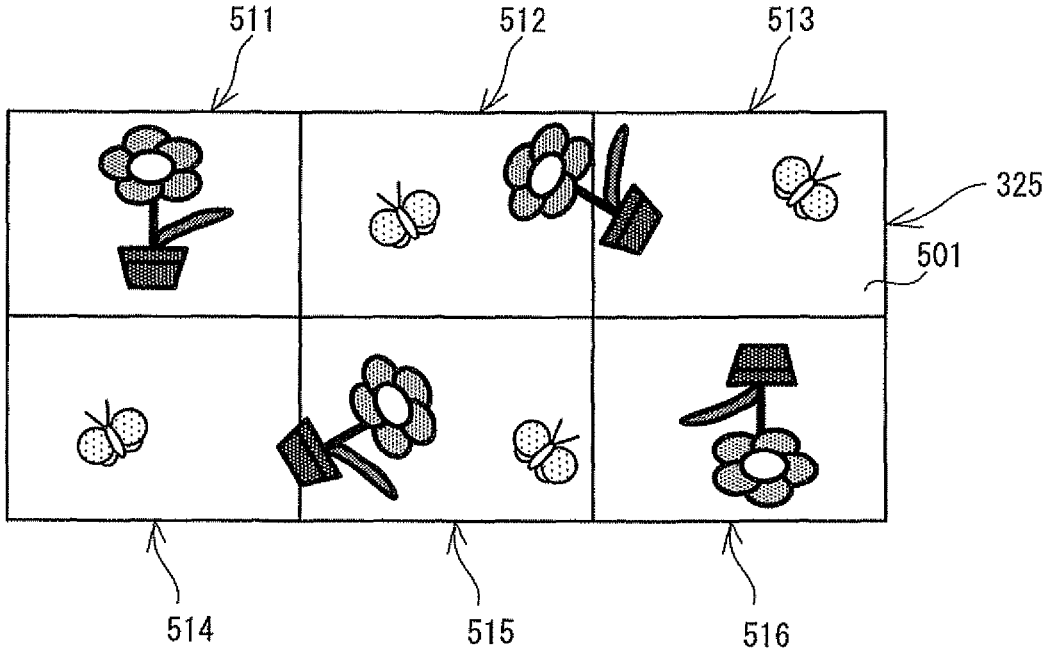
FIG. 14 is an explanatory figure of six small areas of equal size into which a sewing area 325 is divided and of a sewing object 501 within the sewing area 325.

In the held state check processing that is shown in FIG. 13, the same step numbers that are used in the composite image creation processing that is shown in FIG. 11 are assigned to steps where the processing is the same as in the composite image creation processing. The explanation will be simplified for the processing that is the same as in the composite image creation processing. A program for performing the held state check processing is stored in the ROM 62 (refer to FIG. 4). The CPU 61 (refer to FIG. 4) performs the held state check processing in accordance with the program that is stored in the ROM 62 in a case where a command is input by a panel operation.

As shown in FIG. 13, in the held state check processing, first, the type of the sewing object 34 is set. The set type is stored in the RAM 63 (Step S205). The type of the sewing object 34 is used in processing that sets a reference value. The reference value is used as a reference for determining whether there is any slack in the sewing object 34 that is held by the embroidery frame 32. Specifically, a type that is designated by a panel operation, for example, is set as the type of the sewing object 34. Next, the processing at Steps S210 to S230, which is the same as in the composite image creation processing that is shown in FIG. 11, is performed. In the specific example, in the processing at Step S210, small areas 511 to 516 that can be obtained by dividing the sewing area 325 into six equal parts are set within the sewing area 325, as shown in FIG. 14. The first position and the second position are set in relation to the each of the small areas 511 to 516. Therefore, in the specific example, twelve move positions are set.

The image that has been created in the processing at Step S230 is converted into a grayscale image. The grayscale image that is created by the conversion is stored in the RAM 63 (Step S240). The method for converting the color image into the grayscale image is known, so an explanation will be omitted. Next, in a case where, among the move positions EmbPos (N) that were set in the processing at Step S210, a position exists to which the embroidery frame 32 has not yet been moved (NO at Step S250), N is incremented by one (Step S255), and the processing returns to Step S220. In a case where the embroidery frame 32 has been moved to all of the positions (YES at Step S250), a variable P is set to 1. The set variable P is stored in the RAM 63 (Step S290). The variable P is a variable that is used for reading, in order, the small areas 511 to 516 that were created to divide the sewing area 325 into six equal parts. Next, the first image and the second image that were captured of the P-th small area are read in order, and the processing at Steps S300 and S310 is performed.

In the processing at Step S300, the image coordinates are computed for the corresponding points in the first image and the second image of the P-th small area. In the specific example, the corresponding points are set based on the pattern of the sewing object 501. In the processing at Step S310, the three-dimensional coordinates of the corresponding points in the world coordinate system 100 are computed based on the coordinates that were computed in the processing at Step S300, using the same sort of processing as the processing at Step S80 in the position information acquisition processing that is shown in FIG. 6. Next, a determination is made as to whether the three-dimensional coordinates in the world coordinate system 100 have been computed for the corresponding points in all of the small areas (Step S320). In a case where a small area exists for which the three-dimensional coordinates in the world coordinate system 100 have not yet been computed (NO at Step S320), the variable P is incremented by one. The incremented variable P is stored in the RAM 63 (Step S330). The processing then returns to Step S300. In a case where the three-dimensional coordinates in the world coordinate system 100 have been computed for all of the small areas (YES at Step S320), the deviation in the values of Zw, which each denote the thickness of the sewing object 34, among the three-dimensional coordinates in the world coordinate system 100 that were computed in the processing at Step S310 are computed. The computed deviation is stored in the RAM 63 (Step S340). In the present embodiment, one value for Zw is computed for each of the small areas. Accordingly, in the processing at Step S340, the deviation for the six values of Zw is computed.

Next, a determination is made as to whether the deviation that was computed in the processing at Step S340 is not greater than the reference value (Step S350). In the present embodiment, the reference values are set in advance in accordance with the types of the sewing objects, as shown in FIG. 15. The set reference values are stored in the EEPROM 64. For example, for a waffle fabric and a quilted fabric, the reference values are set to be larger than for a flat fabric. In the processing at Step S350, the deviation that was computed in the processing at Step S340 is compared to the reference value that corresponds to the type of the sewing object 34 that was set in the processing at Step S205. In a case where the deviation is not greater than the reference value (YES at Step S350), a message that says, "Cloth is being held properly in embroidery frame," for example, is displayed as the held state check result on the LCD 10 (Step S360). In a case where the deviation is greater than the reference value (NO at Step S350), a message that says, "Cloth is slack. Please remount cloth," for example, is displayed as the held state check result on the LCD 10 (Step S370). After the processing at one of Steps S360 and S370, the held state check processing is terminated.

According to the sewing machine 1 according to the third embodiment, the user is able to check whether the sewing object 501 is being held properly in the embroidery frame 32, without any slack. This makes it possible to prevent the occurrence of a sewing defect that is due to slack in the sewing object 501 before the defect occurs.

The sewing machine 1 of the present disclosure is not limited to the embodiments that have been described above, an various types of modifications can be made within the scope of the claims of the present disclosure. For example, the modifications described in (A) to (D) below may be made as desired.

(A) The configuration of the sewing machine 1 may be modified as desired. For example, the sewing machine 1 may be modified as described in (A-1) to (A-3) below.

(A-1) The image sensor 50 that the sewing machine 1 includes may be one of a CCD camera and another image capture element. The mounting position of the image sensor 50 can be modified as desired, as long as the image sensor 50 is able to acquire an image of an area on the bed 2.

(A-2) The embroidery unit 30 includes the X axis motor 81 and the Y axis motor 82. However, the embroidery unit 30 may include one of the X axis motor 81 and the Y axis motor 82. For example, the sewing object may be moved by a feed dog.

(A-3) The device that provides the notification of the held state of the sewing object may be a device other than the LCD 10. For example, the sewing machine 1 may include one of a buzzer and a speaker as the device that provides the notification of the held state of the sewing object.

(B) The camera coordinate system, the world coordinate system, and the embroidery coordinate system may be associated with one another by parameters that are stored in the sewing machine 1. The methods for defining the camera coordinate system, the world coordinate system, and the embroidery coordinate system may be modified as desired. For example, the embroidery coordinate system may be defined such that the upper portion of the up-down direction of the sewing machine 1 is defined as positive on the Z axis.

(C) The size and the shape of the marker, the design of the marker, and the number of markers can be modified as desired. The design of the marker may be a design that makes it possible to specify the marker based on the image data that are created by capturing an image of the marker. For example, the colors with which the marker 180 is filled in are not limited to black and white and may be any combination of colors for which a contrast is clearly visible. For example, the marker may be modified according to the color and the pattern of the sewing object 34.

(D) The processing that is performed in the position information acquisition processing, the composite image creation processing, and the held state check processing may be modified as desired. For example, the modifications described below may be made.

(D-1) In the processing that is described above, the corresponding point between the first image and the second image is determined based on one of the pattern of the sewing object 34 and the marker 180 that is disposed on the surface of the sewing object 34. However, the corresponding point between the first image and the second image may also be determined by another method. For example, a pattern that the user has drawn on the sewing object using a marker such as an air-soluble marker or the like may be defined as the corresponding point.

(D-2) In the composite image creation processing, in a case where the thickness of the sewing object is uniform, the thickness of the sewing object may be computed using one set of the first image and the second image. Therefore in a case where the composite image is created by combining more than two images, there may not be a pattern in an area where an image that is not used in computing the thickness overlaps another image. For example, the composite image may be created using a plurality of sewing object thicknesses that are computed using a plurality of sets of the first image and the second image.

(D-3) In the held state check processing, the locations where the thickness is detected and the number of locations where the thickness is detected may be modified as desired. The held state that is detected by the held state check processing may be determined by detecting variations in the tension of the sewing object, for example, instead of detecting slack in the sewing object. In the held state check processing, the held state is determined based on the result of a comparison between the reference value and the deviation among the thicknesses of the sewing object that are detected at a plurality of locations. However, the held state may be determined based on another method that uses the thicknesses of the sewing object that are detected at the plurality of locations. The other method may be, for example a method that determines the held state based on the result of a comparison between the reference value and the variance of the thicknesses of the sewing object.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a moving portion that is configured to move a sewing object to a first position and to a second position, the sewing object having a pattern, and the second position being different from the first position;

an image capture portion that is configured to create an image by image capture of the sewing object;

a first acquiring portion that is configured to acquire a first image created by image capture of a first area by the image capture portion, the first area including the pattern of the sewing object positioned at the first position;

a second acquiring portion that is configured to acquire a second image created by image capture of a second area by the image capture portion, the second area including the pattern of the sewing object positioned at the second position; and a computing portion that is configured to compute, as position information, three-dimensional coordinates of a position on a surface of the sewing object at a portion where the pattern is located, based on the first position, the second position, a position of the pattern in the first image, and a position of the pattern in the second image.

2. The sewing machine according to claim 1, wherein the pattern is a marker disposed on the surface of the sewing object.

3. The sewing machine according to claim 1, further comprising:

a creating portion that creates a composite image by combining the first image and the second image based on the position information computed by the computing portion.

4. The sewing machine according to claim 1, wherein the moving portion is configured to move an embroidery frame that holds the sewing object and that is detachably attached to the moving portion.

5. The sewing machine according to claim 4, further comprising:

a detecting portion that detects a held state of the sewing object held by the embroidery frame based on a plurality of pieces of the position information computed by the computing portion; and a notifying portion that provides notification of a result of detecting by the detecting portion.

6. A non-transitory computer-readable medium storing a control program executable on a sewing machine, the program comprising instructions that cause a computer of the sewing machine to perform the steps of:

causing a moving portion of the sewing machine to move a sewing object having a pattern to a first position;

creating a first image by image capture of a first area that includes the pattern of the sewing object positioned at the first position;

acquiring the first image that has been created;

causing the moving portion to move the sewing object to a second position that is different from the first position;

creating a second image by image capture of a second area that includes the pattern of the sewing object positioned at the second position;

acquiring the second image that has been created; and computing, as position information, three-dimensional coordinates of a position on a surface of the sewing object at a portion where the pattern is located, based on the first position, the second position, a position of the pattern in the first image, and a position of the pattern in the second image.

7. The non-transitory computer-readable medium according to claim 6, wherein the pattern is a marker disposed on the surface of the sewing object.

8. The non-transitory computer-readable medium according to claim 6, wherein the program further comprises instructions that cause the computer to perform the step of creating a composite image by combining the first image and the second image based on the position information.

9. The non-transitory computer-readable medium according to claim 6, wherein the moving portion is configured to move an embroidery frame that holds the sewing object and that is detachably attached to the moving portion.

10. The non-transitory computer-readable medium according to claim 9, wherein the program further comprises instructions that cause the computer to perform the step of:

detecting a held state of the sewing object held by the embroidery frame based on a plurality of pieces of the position information that have been computed; and providing notification of a result of detecting of the held state.

* * * * *